US005429052A

United States Patent [19]

Bross et al.

[11] Patent Number: 5,429,052

[45] Date of Patent: Jul. 4, 1995

[54] CIRCUIT ARRANGEMENT FOR FIRING DUMMY TARGET SUB-MEMBERS IN A FREELY SELECTABLE CHRONOLOGICAL SEQUENCE

[75] Inventors: Hans-Peter Bross, Muellheim; Norbert Wardecki, Glottertial, both of Germany

[73] Assignee: Buck Werke GmbH & Co., Bad Uberkingen, Germany

[21] Appl. No.: 99,705

[22] Filed: Jul. 30, 1993

[51] Int. Cl.[6] ..... B23Q 21/00

[52] U.S. Cl. ..... 102/217

[58] Field of Search ..... 102/217; 361/249, 250; 367/1; 342/12

[56] References Cited

U.S. PATENT DOCUMENTS

| | | | |
|---|---|---|---|
| 4,099,467 | 7/1978 | MacKellar et al. | 102/217 |
| 4,183,302 | 1/1980 | Schillreff | 367/1 |
| 4,489,655 | 12/1984 | Molnár | 102/217 |
| 4,796,531 | 1/1989 | Smithies et al. | 102/217 |

*Primary Examiner*—Daniel T. Pihulic

*Attorney, Agent, or Firm*—Hill, Steadman & Simpson

[57] ABSTRACT

A circuit arrangement is provided for firing dummy target sub-members from a cartridge barrel in a freely selectable chronological sequence by igniting ejection charges respectively permanently connected via an electrical ignitor to an ignition circuit and to a respective sub-munition. The ignition circuit—in the condition of the cartridge when it is loaded with sub-munitions arranged above one another—has switch-connection modules, each of which is respectively connected to a sub-munition to provide a series connection. A switch/connection module is a component part of a sub-munition unit to be fired which also has an electrical ignitor, an ejection charge and a sub-munition. The ignition circuit, due to the pluggability of the sub-munition units of the switch/connection modules, can be matched to the respective loading condition of the cartridge such that the ignition circuit automatically forwards an ignition pulse supplied to the cartridge to the ignitor of the respectively uppermost sub-munition unit arranged closest to the mouth of the cartridge.

15 Claims, 2 Drawing Sheets

CIRCUIT ARRANGEMENT FOR FIRING DUMMY TARGET SUB-MEMBERS IN A FREELY SELECTABLE CHRONOLOGICAL SEQUENCE

The present invention generally relates to a circuit arrangement for firing dummy target sub-members. More specifically, the present invention relates to a circuit arrangement for firing dummy target sub-members in a freely selectable chronological sequence from a cartridge barrel by triggering respective ejection charges connected via an electrical ignitor to an ignition circuit and to a respective sub-munition unit.

Dummy target sub-members are generally known for forming a dummy target member for defending an object such as, for example, a land vehicle, an air vehicle or a water vehicle onto which a projectile having an "intelligent" target-seeking member that is sensitive to object contours is directed. In this regard, German Patent Application P 42 32 038.3 discloses a method for offering a dummy target member that simulates a target signature of a targeted object for an imaging, radiation-sensitive target-seeking member having spectral discrimination.

The above-identified German Patent Application discloses how effective mass, for example in the form of rapid-fire ammunition of a comparatively small caliber, is brought to fractioning at the location of the dummy target member. To this end, essentially continuous monitoring of the dummy target member to be three-dimensionally constructed is computer controlled. The three-dimensional model is spatially or chronologically offset such that the target signature of the object to be protected is simulated in "deceptive similarity" for imaging of target-seeking members such as infrared heads. The object to be protected can be simulated more naturally from a higher cadence firing sequence and a smaller caliber of the effective masses.

Firing of dummy target sub-members for forming a dummy target must be precisely controllable in view of spatial as well as chronological correlation in order to imitate the target signature of an object to be protected with misleading trueness. For a cartridge loaded with sub-munitions, this means, for example, that a firing sequence must be triggered without error and with optimally slight delay times. A disadvantage of traditional system cablings is that all sub-munitions are connected to central electronics of an ignition circuit. As a result, a finite "dead time" arises when selecting the next sub-munition arranged at the mouth of the cartridge that is to be fired next, given monitoring of the charge condition of the cartridge. Further, careful connection Of the sub-munitions with a system cabling is time-intensive when loading a cartridge.

Many hurling systems for known sub-munitions also have no drive possibility of the central electronics connected to the sub-munitions. Therefore, a disadvantage results since a designational firing of the sub-munitions is prevented.

SUMMARY OF THE INVENTION

The present invention provides a circuit arrangement wherein an ignition circuit having a cartridge loaded with sub-munitions arranged one above another comprises a plurality of switch/connection modules connected to a sub-munition and pluggable together to provide a series connection. A switch/connection module is a component part of a sub-munition unit to be fired that also comprises an electrical ignitor, an ejection charge and a sub-munition. Due to the pluggability of the sub-munition units of the switch/connection modules, the ignition circuit can be matched to the respective charge condition of the cartridge such that the ignition circuit automatically conducts a trigger pulse supplied to the cartridge to the ignitor of the sub-munition unit that is respectively uppermost and most clearly arranged to the mouth of the cartridge.

It is, therefore, an advantage of the preset invention to provide a sub-munition unit loaded first into the cartridge having an electrical ignitor that, for producing an electrical contact to the ignition circuit, is plugged into the switch/connection module of the sub-munition unit lying therebelow. The sub-munition unit comprises an ejection charge and a sub-munition, but does not comprise a switch/connection module.

Further, a switch/connection module of a sub-munition unit comprises a first switch having two switch conditions in a housing, wherein a first switch condition can be activated plugging into a further sub-munition unit such that an electrical contact between the ignition circuit and the most recently plugged-in sub-munition unit is produced. Electrical contact of the ignition circuit to the ignitor of the sub-munition unit is interrupted, and a second switch condition insures that the ignitor of the sub-munition unit has electrical contact to the ignition circuit.

The invention further provides first switches of the ignition circuit having light barriers.

In addition, the present invention provides first switches of the ignition circuit having mechanical microswitches.

As a result, a first switch can be automatically switched by insertion or pulling of a cable plug of the upper sub-munition unit into or out of a cable socket, respectively. The cable socket is arranged in the housing of the first switch.

Another advantage of the present invention is to provide a cartridge inductively supplied with ignition pulses via a coil wherein the coil is arranged in a bottom element of the cartridge lying opposite the mouth and is connected to the ignition circuit.

Yet another advantage of the present invention is to provide a cartridge supplied with ignition pulses based on a contact transmission.

Still further, an advantage of the present invention is to provide a sensing circuit that, in the loaded condition of the cartridge, comprises a characteristic impedance per sub-munition for the purpose of identifying a charge condition of the cartridge without performing operations within a cartridge barrel from outside the barrel.

To this end, a sensing circuit comprises a switch/connection element that is connected to the cartridge but is not fired out of the cartridge barrel. The switch/connection element has a second switch wherein the second switch insures that the sensing circuit is disconnected from current in a non-loaded condition of the cartridge and otherwise has electrical contact to a characteristic impedance of the sub-munition unit loaded into the cartridge barrel in a lowest position based on a plug-type connector.

The sensing circuit in the loaded condition of the cartridge comprises a plurality of switch/connection elements that are each respectively connected to a characteristic impedance and can be plugged together for a series connection. Each characteristic impedance and each switch/connection element is a component part of a sub-munition unit to be fired, and the switch/connection elements of the sensing circuit can be connected with plug-type connections to insure that flow of current in the sensing circuit is suppressed above a respectively uppermost characteristic impedance. Overall impedance of the sensing circuit measured from the outside is composed of the characteristic impedances of the sub-munition units loaded in the cartridge.

In an embodiment, the overall impedance of the sensing circuit is measured from the outside via contact rings in a bottom element of the cartridge.

In an embodiment, characteristic impedances are connected in parallel via switch/connection elements of the sensing circuit.

In an embodiment, the sub-munition unit loaded uppermost into the cartridge comprises no switch/connection element. Further, its characteristic impedances are directly connected via a plug-type connector to the switch/connection element lying therebelow.

In an embodiment, a switch/connection element of a sub-munition unit comprises a third switch in the sensing circuit having two switch statuses, whereby one switch status is activated by being plugged into another sub-munition unit such that the characteristic impedance of the other, most recently plugged-in sub-munition unit is connected in parallel to the sensing circuit. A second switch status insures no current flows in the sensing circuit above the characteristic impedance of the one sub-munition unit.

In an embodiment, the second switch and the third switch of the sensing circuit comprise light barriers.

In an embodiment, the second switch and the third switch of the sensing circuit comprise mechanical switches.

In an embodiment, the second switch or the third switch is automatically switched due to the plug-in or pulling, respectively, of a cable plug of a respectively upper sub-munition unit into or out of a cable socket that is arranged in the housing of the second switch or of the third switch, respectively.

In an embodiment, switch/connection modules of the ignition circuit are arranged adjacent to a wall of the cartridge barrel.

In an embodiment, a switch/connection module of the ignition circuit for a sub-munition unit to be fired is arranged significantly closer to the mouth of the cartridge than the sub-munition.

In an embodiment, the switch/connection elements of the sensing circuit are arranged adjacent to the wall of the cartridge barrel.

In an embodiment, the switch/connection element of the sensing circuit for a sub-munition unit to be fired is arranged substantially closer to the mouth of the cartridge than the sub-munition.

In an embodiment, the switch/connection elements of the sensing circuit are arranged separately from the switch/connection modules of the ignition circuit.

In an embodiment, the switch/connection elements of the sensing circuit and the switch/connection modules of the ignition circuit are arranged close to locations of the cartridge barrel that essentially lie opposite one another.

In an embodiment, the switch/connection module present per sub-munition unit and the switch/connection element are fashioned as a single unit.

In an embodiment, a firing sequence of dummy target sub-members from a cartridge can be initiated essentially without time delays by an ignition circuit based on an automatic, successive forwarding of ignition pulses to the sub-munition respectively arranged closest to the mouth of the cartridge. The ignition circuit is expanded when sub-munition units are plugged together during loading of the cartridge and is dismantled when the cartridge is unloaded such that the ignition circuit automatically adapts to the respective loading condition. Further, the circuit arrangement enables an exact determination of the respective load condition of the cartridge via an overall impedance of a sensing circuit composed of the characteristic impedances of the sub-munition units. The overall impedance of the respective loading condition of the cartridge is likewise automatically derived due to the pluggability of the sub-munition units.

Additional features and advantages of the present invention are described in and will be apparent from the detailed description of the presently preferred embodiments and from the drawings.

DETAILED DESCRIPTION OF THE PRESENTLY PREFERRED EMBODIMENTS

Figure 1:
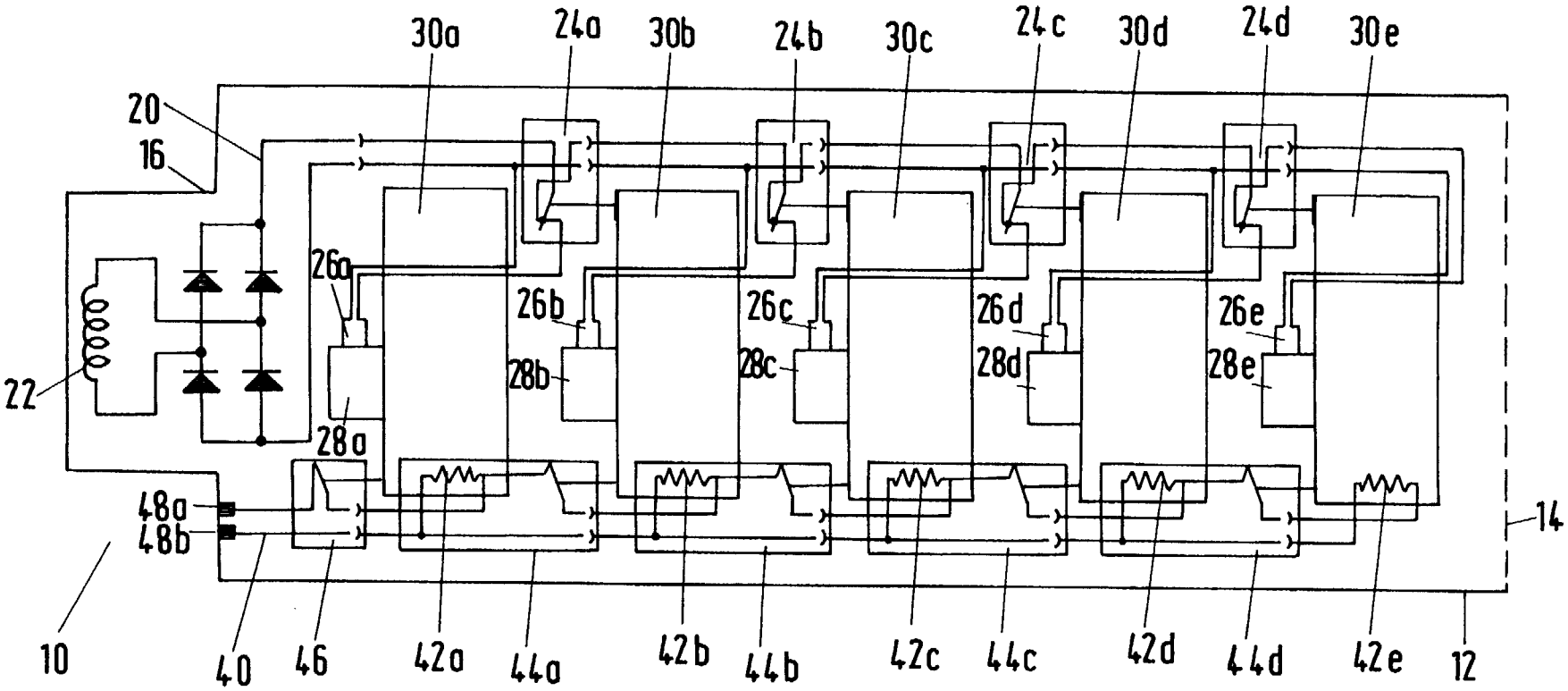
FIG. 1 illustrates a circuit arrangement of the present invention in a longitudinal section through a cartridge.

Referring to the drawings, FIG. 1 generally illustrates a cartridge 10 having a cartridge barrel 12, a mouth 14 and a bottom element 16. The bottom element 16 is part of an ignition circuit 20. The ignition circuit 20 has a coil 22 that can be inductively supplied with trigger pulses from outside the cartridge 10. The ignition circuit 20 further has a pair of current-rectifying diodes.

The bottom element 16 forms a part of a sensing circuit 40 together with two contact rings **48*a*, 48*b*. The overall impedance of the sensing circuit 40 can be measured from outside of the cartridge 10. The cartridge 10 has a switch/connection element 60 that is not to be fired from the cartridge barrel 12**.

As further illustrated in FIG. 1, the cartridge 10 is also loaded with five sub-munition units each of which respectively at least has an electrical ignitor **26*a*, 26*b*, 26*c*, 26*d*, 26*e*, an ejection charge 28*a*, 28*b*, 28*c*, 28*d*, 28*e*, a sub-munition 30*a*, 30*b*, 30*c*, 30*d*, 30*e* and a characteristic impedance 42*a*, 42*b*, 42*c*, 42*d*, 42*e*. Except for the sub-munition unit which includes the electrical ignitor 26*e*, the ejection charge 28*e*, the sub-munition 30*e*, and the characteristic impedance 42*e*, that is, that sub-munition unit arranged at the top closest to the mouth 14 of the cartridge 10, all of the other sub-munition units also respectively comprise a switch/connection module 24*a*, 24*b*, 24*c*, 24*d* for matching of the ignition circuit 20. In addition, all of the other sub-munition units also include a switch/connection element 44*a*, 44*b*, 44*c*, 44*d* for matching of the sensing circuit 40 to the respective load condition of the cartridge 10**.

Figure 2:
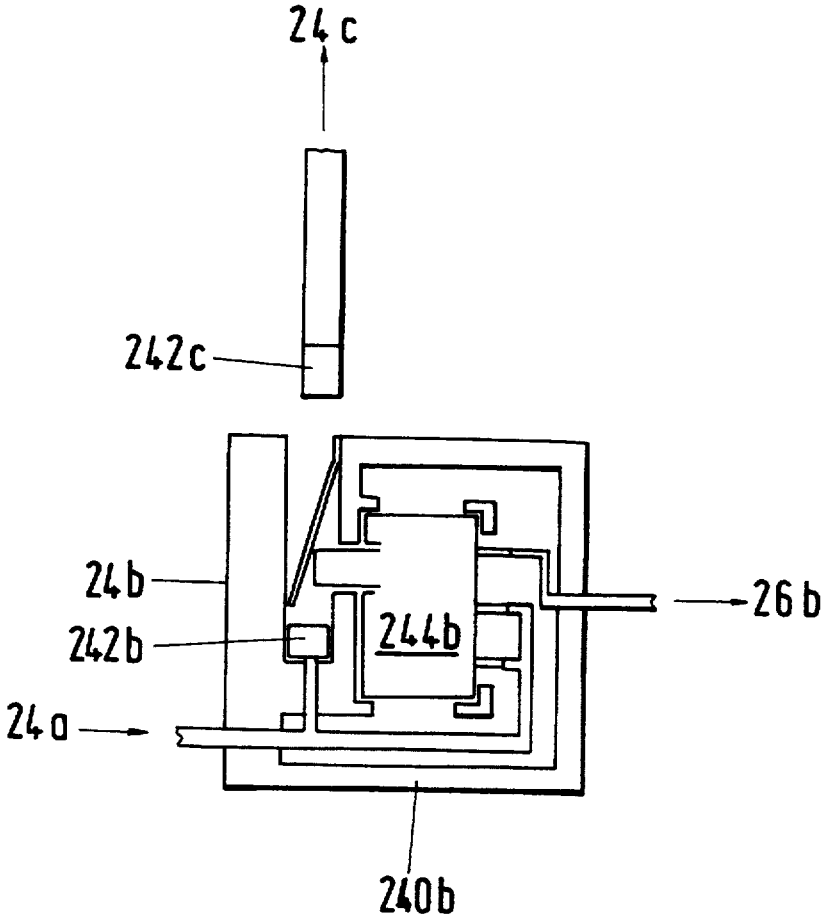
FIG. 2 illustrates an ignition circuit of the present invention in a longitudinal section of a switch/connection module.

The fundamental structure of the switch/connection modules of the ignition circuit 20 may be derived from FIG. 2. The switch/connection module **24*b* belonging to the sub-munition unit consisting of the components 24*b*, 26*b*, 28*b*, 30*b*, 42*b*, 44*b* has a cable socket 242*b* into which a cable plug 242*c* of the switch/connection module 24*c* of another sub-munition unit consisting of the components 24*c*, 26*c*, 28*c*, 30*c*, 42*c*, 44*c* to be loaded farther toward the top can be plugged. The switch/connection module 24b further includes a microswitch 244b that is electrically connectable to the ignitor 26b of the sub-munition unit consisting of the components 24b, 26b, 28b, 30b, 42b, 44b**.

Loading of an empty cartridge barrel 12 with the above-described circuit arrangement occurs as follows. The first sub-munition 30a, along with the characteristic impedance 42a, the ejection charge 28a, the electrical ignitor 26a, the switch/connection module 24a and the switch/connection element 44a, is inserted into the empty cartridge barrel 12 in the lowest position as shown in FIG. 1. Upon insertion of the first sub-munition unit (24a, 26a, 28a, 30a, 42a, 44a), an electrical contact is produced by a plug-type connector between that portion of the ignition circuit 20 in the bottom element 16 of the cartridge 10 and the first ignitor 26a.

Simultaneously, the plug-type connection between the permanently wired switch/connection element 46 in the bottom element 16 and the first switch/connection element 44a that is plugged in insures a switching of the permanently wired switch/connection element 46, As a result, the sensing circuit 40 covers the first characteristic impedance 42a. The sensing circuit 40 is no longer kept free of current by the permanently wired switch/-connection element 46. Rather, flow of current is suppressed by the first switch/connection element 44a that is plugged in above the first characteristic impedance 42a. Therefore, the sensing circuit 40 is disconnected toward the top above the first characteristic impedance 42a.

In the next step, the second sub-munition unit (24b, 26b, 28b, 30b, 42b, 44b) is inserted into the cartridge barrel 12 such that the switch/connection modules 24a, 24b and the switch/connection elements 42a, 42b of the first sub-munition unit (24a, 26a, 28a, 30a, 42a, 44a) and of the second sub-munition unit (24b, 26b, 28b, 30b, 42b, 44b) are connected to one another by plug-type connectors.

The connection between the first switch/connection modules 24a and the second switch/connection module 24b in the ignition circuit 20 thereby insures that the switch/connection module 24a of the first sub-munition unit (24a, 26a, 28a, 30a, 42a, 44a) is switched-over such that an ignition pulse received by the coil 22 is supplied via the ignition circuit 20 and the second switch/connection module 24b to the ignitor 26b of the second sub-munition unit (24b, 26b, 28b, 30b, 42b, 44b). Moreover, the plug-in of the second sub-munition unit (24b, 26b, 28b, 30b, 42b, 44b) in the sensing circuit 40 results in the first switch/connection element 44a being switched-over such that the sensing circuit 40a covers the two characteristic impedances 42a and 42b of the first sub-munition unit (24a, 26a, 28a, 30a, 42a, 44a) and of the second sub-munition unit (24b, 26b, 28b, 30b, 42b, 44b) connected parallel to one another and is disconnected toward the top above the second characteristic impedance 42b by the second switch/connection element 44b.

The third sub-munition unit (24c, 26c, 28c, 30c, 42c, 44b) is inserted into the cartridge barrel 12 in the same way as the second sub-munition unit (24b, 26b, 28b, 30b, 42b, 44b). The ignition circuit 20 is thereby automatically modified in the following way as illustrated in FIG. 2. The second switch/connection module 24b comprises a microswitch 244b secured in a housing 40b that is electrically connected to the first switch/connection module 24a arranged farther toward the bottom.

When no switch/connection module is introduced into the switch/connection module 24b of the second sub-munition unit (24b, 26b, 28b, 30b, 42b, 44b), then the microswitch 244b insures that an ignition pulse received by the coil 22 is supplied to the second electrical ignitor 26b. As shown, however, as the cable plug 242c of the third switch/connection module 24c is inserted into the switch/connection module 24b of the second sub-munition unit (24b, 26b, 28b, 30b, 42b, 44b), an electrical contact between the switch/connection modules 24b and 24c that have just been plugged together is produced via the connection between the cable plug 242c and the cable socket 242b. The microswitch 244b is mechanically forced to change its switch status, so that the electrical ignitor 26b of the second sub-munition unit (24b, 26b, 28b, 30b, 42b, 44b) no longer has any electrical contact to the ignition circuit 20. Instead, the third electrical ignitor 26c is then electrically connected to the ignition circuit 20 via the third switch/connection module 24c.

The connection between the second switch/connection element 44b and the third switch/connection element 44c produced by the insertion of the third sub-munition unit (24c, 26c, 28c, 30c, 42c, 44c) in the sensing circuit 40 automatically matches the sensing circuit 40 to the new loading condition of the cartridge 10. That is, as soon as a cable (not shown) of the third switch/-connection element 44c is inserted into the switch/connection element 44b of the second sub-munition unit (24b, 26b, 28b, 30b, 42b, 44b), the second switch/connection element 44b insures that a current can flow to the third characteristic impedance 42c above the second characteristic impedance 42b. Simultaneously, the switch/connection element 44c of the third sub-munition unit (24c, 26c, 28c, 30c, 42c, 44c) connects the third characteristic impedance 44c parallel to the second characteristic impedance 44c and disconnects the sensing circuit 40 above the third impedance 44c.

In the next step, the fourth sub-munition unit (24d, 26d, 28d, 30d, 42d, 44d) is introduced into the cartridge 10 such that the ignition circuit 20 automatically forwards an ignition pulse to the fourth electrical ignitor 26d. Further, the overall impedance of the sensing circuit 40 is exactly composed of the four characteristic impedances 42a, 42b, 42c and 42d that are connected in parallel to one another.

In the last loading step, the fifth sub-munition unit (26e, 28e, 30e, 42e) is introduced into the cartridge barrel 12. The fifth ignitor 26e is plugged into the fourth switch/connection module 24d of the ignition circuit 20, and the fifth characteristic impedance 42e is plugged into the fourth switch/connection element 44d of the sensing circuit 40. Automatically, the fourth switch/-connection module 24d and the fourth switch/connection element 44d are switched-over such that an ignition pulse received with the coil 22 is no longer supplied to the fourth electrical ignitor 26d but to the fifth electrical ignitor 26e. The overall impedance of the sensing circuit 40 is composed of the five characteristic impedances 42a, 42b, 42c, 42d and 42e that are connected in parallel to one another, and its circuit is directly terminated by the fifth characteristic impedance 42e.

The cartridge 10 loaded in this way can, for example, be utilized for forming a region of a dummy target ship for protecting a ship (not shown), being attached thereto and utilized as follows. A computer unit (not shown) is connected to the two contact rings 48a, 48b of the sensing circuit 40 such that the loading condition of the cartridge 10 can be monitored from the outside at any point in time. Since salt water that surrounds the ship to be protected is electrically conductive and can penetrate into an inside of the cartridge 10, the structure of the switch/connection elements 44*a*, 44*b*, 44*c*, 44*d*, 46 of the sensing circuit 40 must assure that no electrical contact can occur between the salt water and the sensing circuit 40. As a result, an unfalsified overall impedance may be measured of the sensing circuit 40 that correctly reflects the loading condition of the cartridge 10. To this end, the switch/connection elements 44*a*, 44*b*, 44*c*, 44*d*, 46 of the sensing circuit 40 insure that contacts that are open toward the salt water are not present in the sensing circuit 40 at any time.

Given the respective position and the respective loading condition of the cartridge 10, the traveling speed of the ship to be protected, the position and the traveling speed of the ship simulation to be constructed, and the region of the cartridge 10 to be targeted, the computer unit determines the firing sequence of the sub-munitions 30*a*, 30*b*, 30*c*, 30*d*, 30*e* by offering ignition pulses at predetermined time intervals.

A first ignition pulse received via the coil 22 is automatically supplied by the ignition circuit 20 directly to the ignitor 26*e* of the fifth sub-munition unit (26*e*, 28*e*, 30*e*, 42*e*) such that the fifth sub-munition 30*e* is fired from the cartridge 10 by the ignited, fifth ejection charge 28*e* to simulate a region of the dummy target ship in a position neighboring the ship. When the fifth sub-munition unit (26*e*, 28*e*, 30*e*, 32*e*) is fired out, the plug-type connection between the fifth ignitor 26*e* and the fourth switch/connection module 24*d* in the ignition circuit 20 as well as between the fifth characteristic impedance 42*e* and the fourth switch/connection element 44*d* of the sensing circuit 40 is destroyed.

As a consequence of the foregoing, the switch/connection module 24*d* of the fourth sub-munition unit (24*d*, 26*d*, 28*d*, 30*d*, 42*d*, 44*d*) automatically switches over such that the fourth electrical ignitor 26*d* has electrical contact to the ignition circuit 20. Further, the fourth switch/connection element 44*d* switches over such that the overall impedance of the sensing circuit 40 is now composed exactly of the four characteristic impedances 42*a*, 42*b*, 42*c* and 42*d* that are connected in parallel to one another. The switch/connection element 44*d* of the fourth sub-munition unit (24*d*, 26*d*, 28*d*, 30*d*, 42*d*, 44*d*) in the sensing circuit 40 additionally insures a termination of the sensing circuit 40 in an upward direction above the fourth characteristic impedance 42*d*, i.e. toward the salt water, to prevent any influence by salt water of the overall impedance that indicates the loading condition of the cartridge 10.

If the computer unit initiates a second ignition pulse, then the pulse proceeds inductively to the coil 22 which is then successively supplied via the ignition circuit 20 to the electrical ignitor 26*d*. The fourth sub-munition unit (24*d*, 26*d*, 28*d*, 30*d*, 42*d*, 44*d*) from the ignition of the ejection charge 28*d* is immediately fired from the cartridge barrel 12. The connection between the third and fourth switch/connection modules 24*c*, 24*d* and the switch/connection elements 44*c*, 44*d* is thereby severed. The third switch/connection module 24*c* and the third switch/connection element 44*c* that are arranged uppermost are thereby automatically switched such that the ignition circuit 20 is directly connected to the electrical ignitor 26*c* of the third sub-munition unit 24*c*, 26*c*, 28*c*, 30*c*, 42*c*, 44*c*.

Further, the sensing circuit 40 is upwardly terminated above the third characteristic impedance 42*c* in order to avoid electrical contact with salt water. The overall impedance of the sensing circuit 40 is thereby exactly established by the three characteristic impedances 42*a*, 42*b* and 42*c* connected in parallel to one another.

A third ignition pulse triggered by the computer unit leads to a firing of the third sub-munition unit (24*c*, 26*c*, 28*c*, 30*c*, 42*c*, 44*c*). The cable plug 242*c* of the third switch/connection module 24*c* that has been fired out is thereby pulled from the cable socket 242*b* of what is now the switch/connection module 26*b* of the second sub-munition unit (24*b*, 26*b*, 28*b*, 30*b*, 42*b*, 44*b*) that is now arranged uppermost in order to separate the contact between the second and the third switch/connection modules 24*b* and 24*c*, respectively. This mechanically switches the microswitch 244*b* such that the switch 244*b* produces an electrical contact between the switch/connection module 24*a* of the first sub-munition unit (24*a*, 26*a*, 28*a*, 30*a*, 42*a*, 44*a*) arranged at the very bottom to the second ignitor 26*b* as illustrated in FIG. 2. Moreover, the overall impedance after the firing of the third switch/connection element 44*d* in the sensing circuit 40 is composed of the two resistors 42*a* and 42*b* that are connected in parallel to one another since the sensing circuit 40 is isolated from the salt water.

A fourth ignition pulse initiated by the computer unit insures a firing of the second sub-munition unit (24*b*, 26*b*, 28*b*, 30*b*, 42*b*, 44*b*). The ignitor 26*a* of the first sub-munition unit (24*a*, 26*a*, 28*a*, 30*a*, 42*a*, 44*a*) is now electrically connected to the inductance coil 22 via the first switch/connection module 24*a*. Moreover, the loading condition of the cartridge 10 can then be read from the impedance 22*a* above which no current can now flow in the sensing circuit 40.

Finally, a fifth ignition pulse triggered by the computer unit insures the firing of the first and last sub-munition unit (24*a*, 26*a*, 28*a*, 30*a*, 42*a*, 44*a*) resulting in an emptying of the cartridge 10. As may be derived from the sensing circuit 40 that is closed off from salt water by the permanently wired switch/connection element 46, no characteristic impedance is now exhibited.

The emptied cartridge barrel 12 can then be reloaded in the manner as previously set forth. To this end, the cartridge 10 having no sub-munitions is preferably separated from the ship to be protected and is completely removed from the salt water.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim as our invention:

1. A circuit arrangement for firing dummy target sub-members in a freely selectable chronological sequence from a cartridge barrel of a cartridge with an ignition circuit wherein the ignition circuit is completable for n sub-munitions by plugging upon each other n sub-munition units by plugged connections firable as a whole in succession starting with one arranged closest to a cartridge mouth being an uppermost sub-munition unit, said n sub-munition units each comprising at least an electrical ignitor, an ejection charge and a sub-munition wherein $n > 1$ and further wherein at least the lower (n − 1) sub-munition units further comprise a switch/-connection module wherein each switch/connection module is wired by the plugged connection such that an ignition pulse is automatically forwarded to the ignitor of the respective uppermost sub-munition unit; and a sensing circuit completable by plugging upon each other the n sub-munition units, simultaneously and in the same manner as said ignition circuit, each sub-munition unit comprising a characteristic impedance wherein at least the lower (n − 1) sub-munition units further comprising a switch/connection element wherein each switch/connection element is wired by the plugged connection such that the current flow in the sensing circuit is suppressed above the respective uppermost characteristic impedance and further such that the overall impedance of the sensing circuit to be measured from Outside is composed of the characteristic impedances of the sub-munition units loaded in the cartridge.

2. The circuit arrangement of claim 1 wherein the switch connection element of the sensing circuit is permanently connected to the cartridge that is not fired from the cartridge barrel and has a second switch wherein the second switch insures that the sensing circuit in a non-loaded condition of the cartridge is disconnected from a current and otherwise has electrical contact to the characteristic impedance of the sub-munition unit loaded at a lowest point with a plugged connection into the cartridge barrel.

3. The circuit arrangement of claim 2, wherein the switch/connection elements are each connected to a characteristic impedance and can be plugged together for series connection, wherein each characteristic impedance and each switch/connection element is a component part of a sub-munition unit to be fired and the switch/connection elements of the sensing circuit connected with plug-type connections insure that flow of current in the sensing circuit is suppressed above an uppermost characteristic impedance and overall impedance of the sensing circuit to be measured from the outside is composed of the characteristic impedances of the sub-munition units loaded in the cartridge.

4. The circuit arrangement of claim 3, wherein the overall impedance of the sensing circuit is measured from the outside by contact rings in the bottom element of the cartridge.

5. The circuit arrangement of claim 3, wherein the characteristic impedances are connected in parallel to one another via the switch/connection elements of the sensing circuit.

6. The circuit arrangement of claim 3, wherein the uppermost sub-munition unit in the cartridge has no switch/connection element and its characteristic impedance is directly connected to the switch/connection element lying therebelow via a plug-type connector.

7. The circuit arrangement of claim 3, wherein a switch/connection element of a sub-munition unit has a third switch having two switch statuses in the sensing circuit, such that one switch status is activated by the plug-in of the further sub-munition unit and such that the characteristic impedance of the further, most recently plugged-in sub-munition unit is added in parallel to the sensing circuit, and a second switch status insures that no current flows in the sensing circuit above the characteristic impedance of the one sub-munition unit.

8. The circuit arrangement of claim 7, wherein the second switch and the third switch of the sensing circuit have light barriers.

9. The circuit arrangement of claim 7, wherein the second switch and the third switch of the sensing circuit have mechanical switches.

10. The circuit arrangement of claim 9, wherein the second switch and the third switch are automatically switched by the plug-in or pulling of a cable plug of the upper sub-munition unit into or out of, respectively, a cable socket arranged in the housing of the second switch or the third switch, respectively.

11. The circuit arrangement of claim 1 wherein the switch/connection elements of the sensing circuit are arranged adjacent to the wall of the cartridge barrel.

12. The circuit arrangement of claim 1 wherein the switch/connection element of the sensing circuit for a sub-munition unit to be fired is arranged essentially closer to the mouth of the cartridge than the sub-munition.

13. The circuit arrangement of claim 1 wherein the switch/connection elements of the sensing circuit are arranged separately from the switch/connection modules of the ignition circuit.

14. The circuit arrangement of claim 13, wherein the switch/connection elements of the sensing circuit and the switch/connection modules of the ignition circuit are arranged close to locations of the cartridge barrel that essentially lie opposite one another.

15. The circuit arrangement of claim 1 wherein the switch/connection modules and the switch/connection element present per sub-munition unit are fashioned as a single unit.

* * * * *